US010863820B1

(12) United States Patent
Lin

(10) Patent No.: US 10,863,820 B1
(45) Date of Patent: Dec. 15, 2020

(54) SLIDE TYPE ELEVATING POST

(71) Applicant: TIMOTION TECHNOLOGY CO., LTD., New Taipei (TW)

(72) Inventor: Yu-Chang Lin, New Taipei (TW)

(73) Assignee: TIMOTION TECHNOLOGY CO., LTD., New Taipei (TW)

( * ) Notice: Subject to any disclaimer, the term of this patent is extended or adjusted under 35 U.S.C. 154(b) by 6 days.

(21) Appl. No.: 16/457,675

(22) Filed: Jun. 28, 2019

(30) Foreign Application Priority Data

May 27, 2019 (TW) ..... 108206657 U

(51) Int. Cl.
*A47B 9/04* (2006.01)
*A47F 5/10* (2006.01)
*B25H 1/10* (2006.01)

(52) U.S. Cl.
CPC ..... *A47B 9/04* (2013.01); *A47B 2009/046* (2013.01); *A47B 2200/0056* (2013.01); *A47F 5/10* (2013.01); *B25H 1/10* (2013.01)

(58) Field of Classification Search
CPC ..... A47B 9/04; A47B 2009/046; A47B 2200/0056; B25H 1/10; A47F 5/10
USPC ..... 248/188.2, 188.3, 188.4
See application file for complete search history.

(56) References Cited

U.S. PATENT DOCUMENTS

2001/0037751 A1* 11/2001 Agee ..... A47B 9/12 108/147
2002/0124777 A1* 9/2002 Lag ..... A47B 9/06 108/20
2017/0135466 A1* 5/2017 Randlov ..... A47B 9/20
2017/0303679 A1* 10/2017 Tseng ..... A47B 9/04
2018/0140087 A1* 5/2018 Wu ..... F16H 25/2056
2018/0184799 A1* 7/2018 Lin ..... A47B 9/04
2018/0325257 A1* 11/2018 Xiang ..... A47B 51/00

* cited by examiner

*Primary Examiner* — Muhammad Ijaz
(74) *Attorney, Agent, or Firm* — Chun-Ming Shih; HDLS IPR Services

(57) ABSTRACT

An elevating post includes a transmission (10), a driver (20), an outer tube (30) and a moving assembly (40). The driver (20) is connected to the transmission (10). The outer tube (30) receives the transmission (10) and the driver (20) and has a tube body (31) with a longitudinal trough (311). Two closed sections (312, 313) are separately disposed outside two ends of the longitudinal trough (311). The moving assembly (40) is operatably connected to the transmission (10) and has a plate (43) protruding from the tube body (31) by passing through the longitudinal trough (311) and being movable in the longitudinal trough (311).

9 Claims, 8 Drawing Sheets

SLIDE TYPE ELEVATING POST

BACKGROUND OF THE INVENTION

Technical Field

The invention relates to elevating posts, particularly to a slide type elevating post.

Related Art

Elevating posts being used for elevation of displays or work tables is very common. However, a current elevating post primarily includes an outer tube and an inner tube. Elevation can be done by projecting the inner tube from the outer tube or the outer tube from the inner tube. In both static and dynamic transition, the overall installing size will vary visibly and the rigidity is considerably reduced. Also, the exposed outer tube or inner tube will cause derogation of appearance and damage of human body or the elevating post resulting from collision.

SUMMARY OF THE INVENTION

An object of the invention is to provide a slide type elevating post, which uses a plate to slide in a trough to achieve elevation. This can keep both the installing size and rigidity constant in static and dynamic transition.

To accomplish the above object, the elevating post of the invention includes a transmission, a driver, an outer tube and a moving assembly. The driver is connected to the transmission. The outer tube receives the transmission and the driver and has a tube body with a longitudinal trough. Two closed sections are separately disposed outside two ends of the longitudinal trough. The moving assembly is operatably connected to the transmission and has a plate protruding from the tube body by passing through the longitudinal trough and being movable in the longitudinal trough.

The invention also has the following effects. By the moving assembly sheathed in the outer tube, overall appearance can be improved. By the plate passing through the trenches and being embedded into the channel, the plate is fixed onto the nut in a horizontal direction. By the blocking portion being blocked by the top of the nut, the plate can be fixed to the nut in a vertical direction. This makes assembling simple and easy. The closed sections outside two ends of the longitudinal trough can enhance the overall strength without deformation.

DETAILED DESCRIPTION OF THE INVENTION

Please refer to FIGS. 1-7. The invention provides a slide type elevating post, which includes a transmission 10, a driver 20, an outer tube 30 and a moving assembly.

Figure 5:
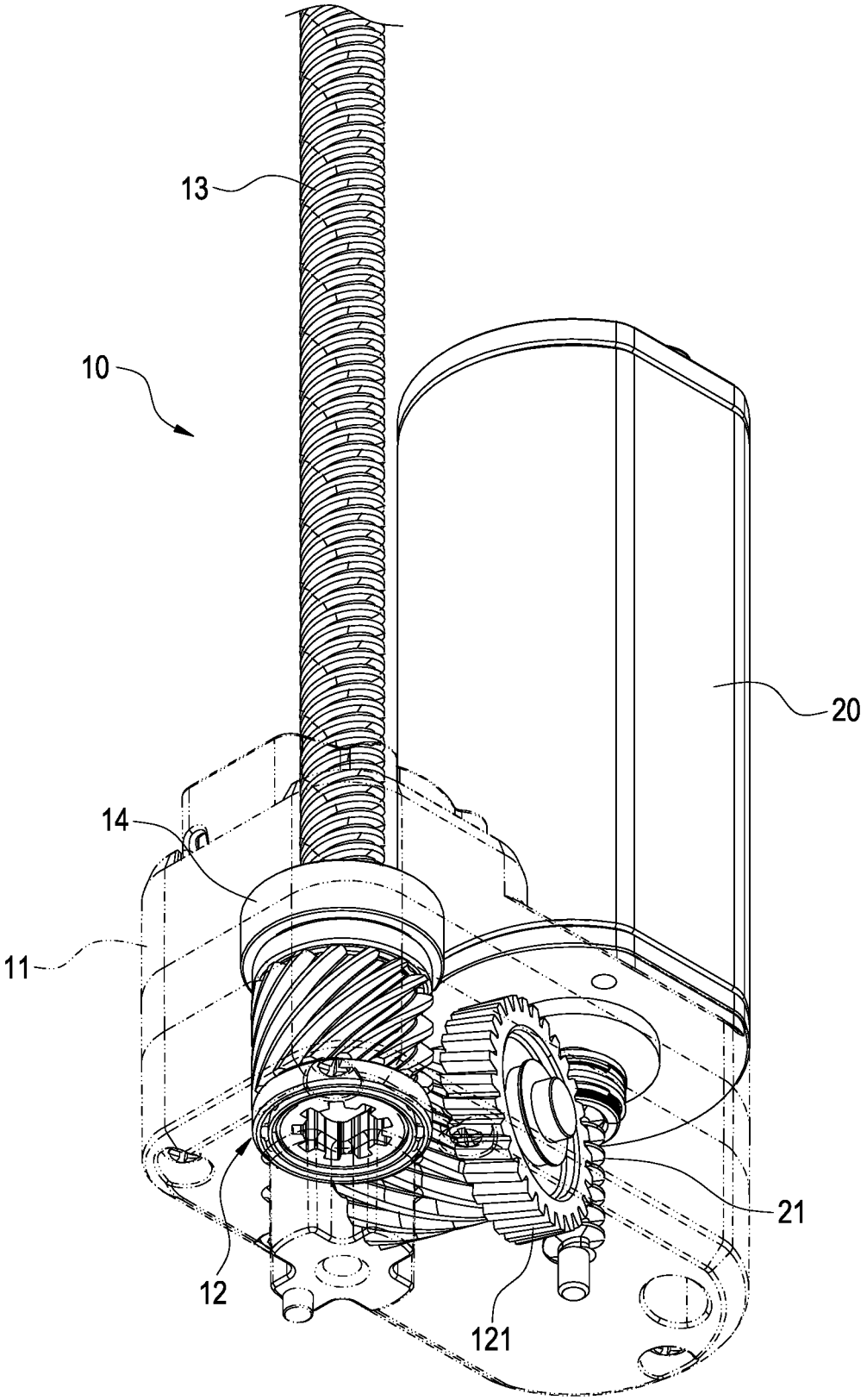
FIG. 5 is a schematic view of the transmission and the driver of the invention.

Please refer to FIG. 5 first. The transmission 10 includes a gearbox 11, a reduction gear set 12, a lead screw 13 and bearings 14. The reduction gear set 12 is installed in the gearbox 11 and has gears engaging with each other for transmission. An end of the lead screw 13 passes through a gear of the reduction gear set 12 and is supported in the gearbox 11 through the bearings 14. The other end of the lead screw 13 vertically extends away from the gearbox 11.

Figure 3:
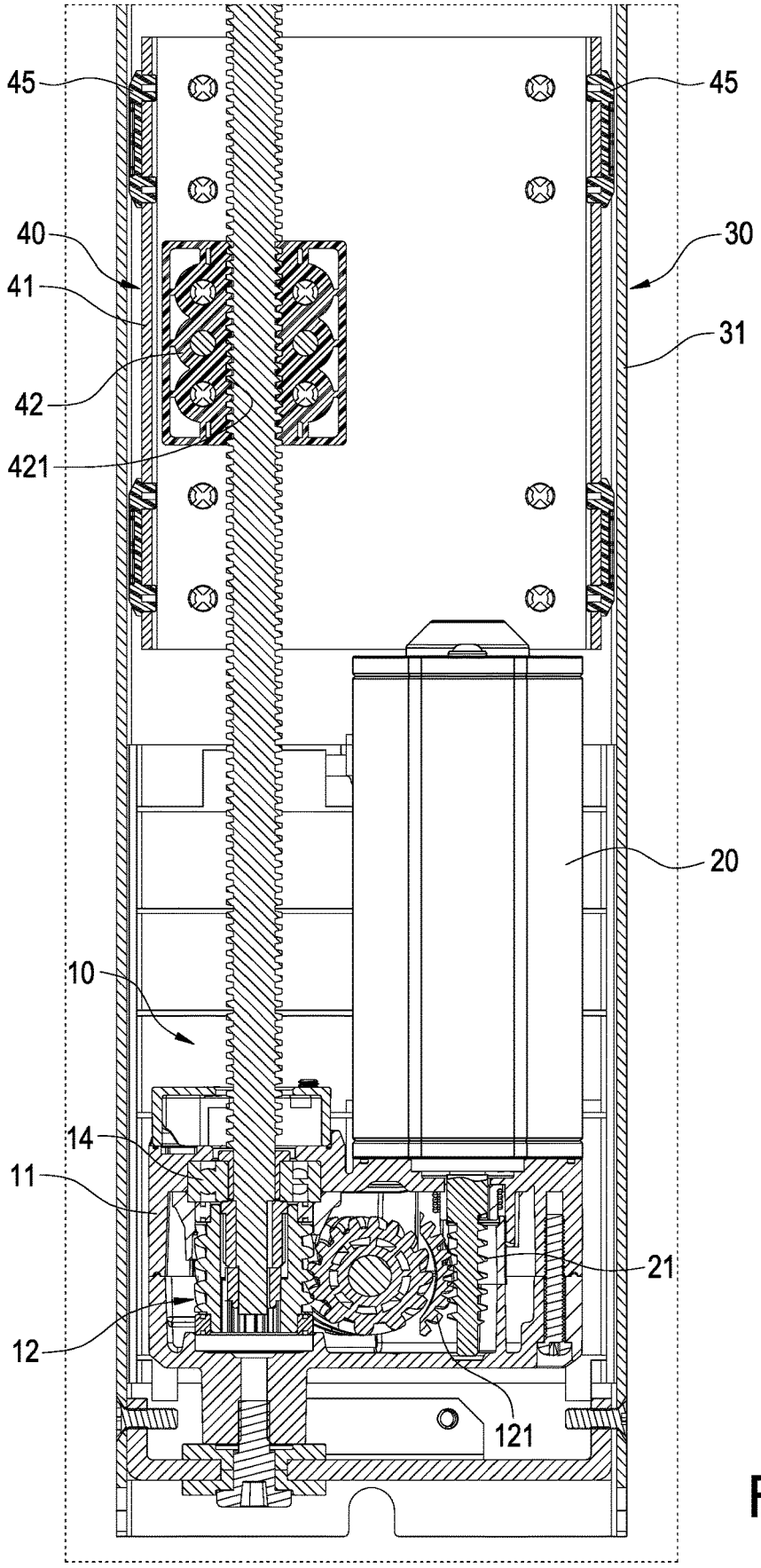
FIG. 3 is a cross-section view of the invention.

Please refer to FIG. 3. The driver 20 in the embodiment is a motor, which is vertically connected to the gearbox 11 and parallel to the lead screw 13. The driver 20 has a worm 21. The reduction gear set 12 has a worm gear 121. The gears and the lead screw 13 can be driven by the driver 20 through the engagement of the worm gear 121 and the worm 21.

Figure 1:
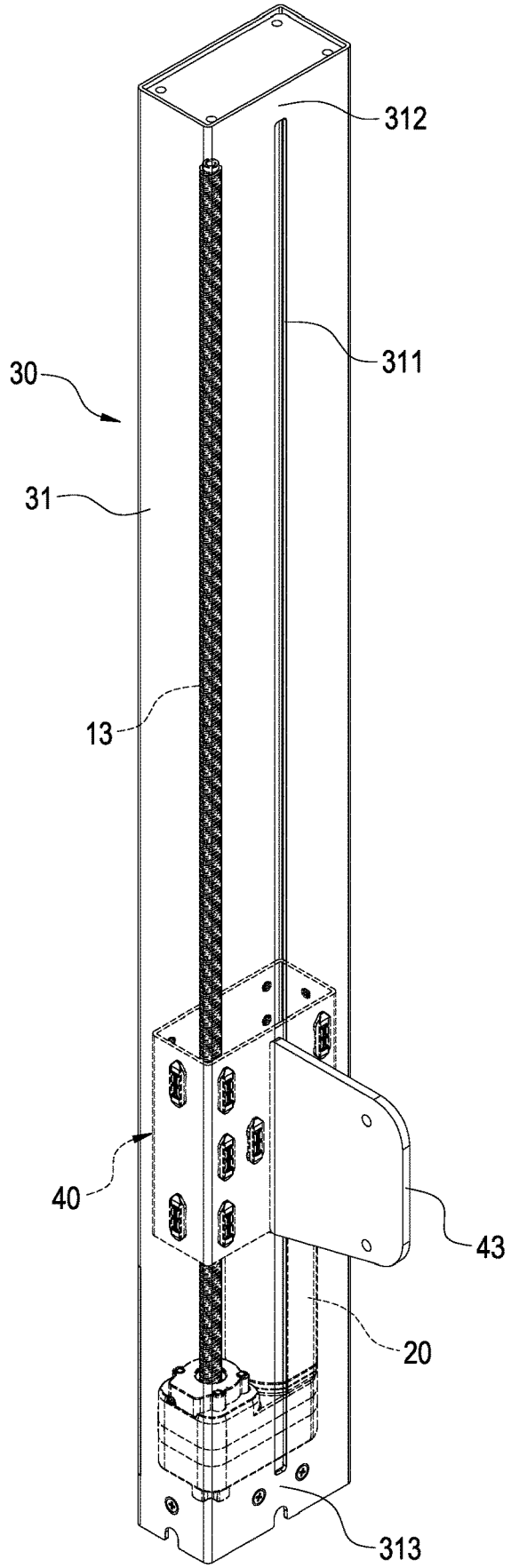
FIG. 1 is a perspective view of the invention.
Figure 2:
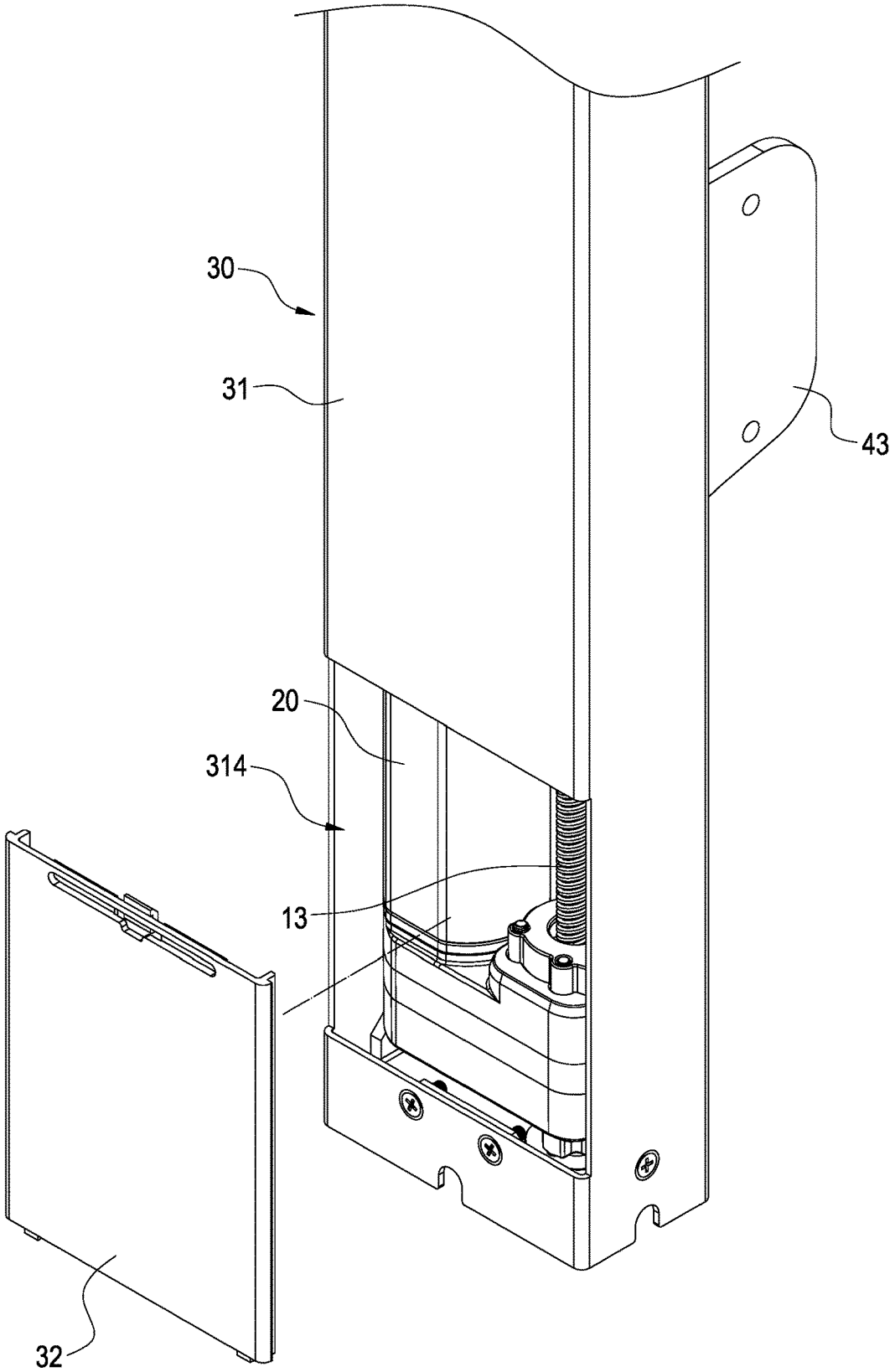
FIG. 2 is an exploded view of the invention with removing the cover.

Please refer to FIGS. 1-3. The outer tube 30 receives the transmission 10 and the driver 20. The outer tube 30 includes a tube body 31. In this embodiment, the outer tube 31 is of a rectangular shape, but not limited to this, circular or other shapes are available. A side panel of the tube body 31 is provided with a longitudinal trough 311. An upper closed sections 312 and a lower closed section 313 are separately disposed outside two ends of the longitudinal trough 311. A side panel of the tube body 31, which is opposite to the longitudinal trough 311, is formed with an opening 314. A cover 32 correspondingly cloaks the opening 314.

Figure 4:
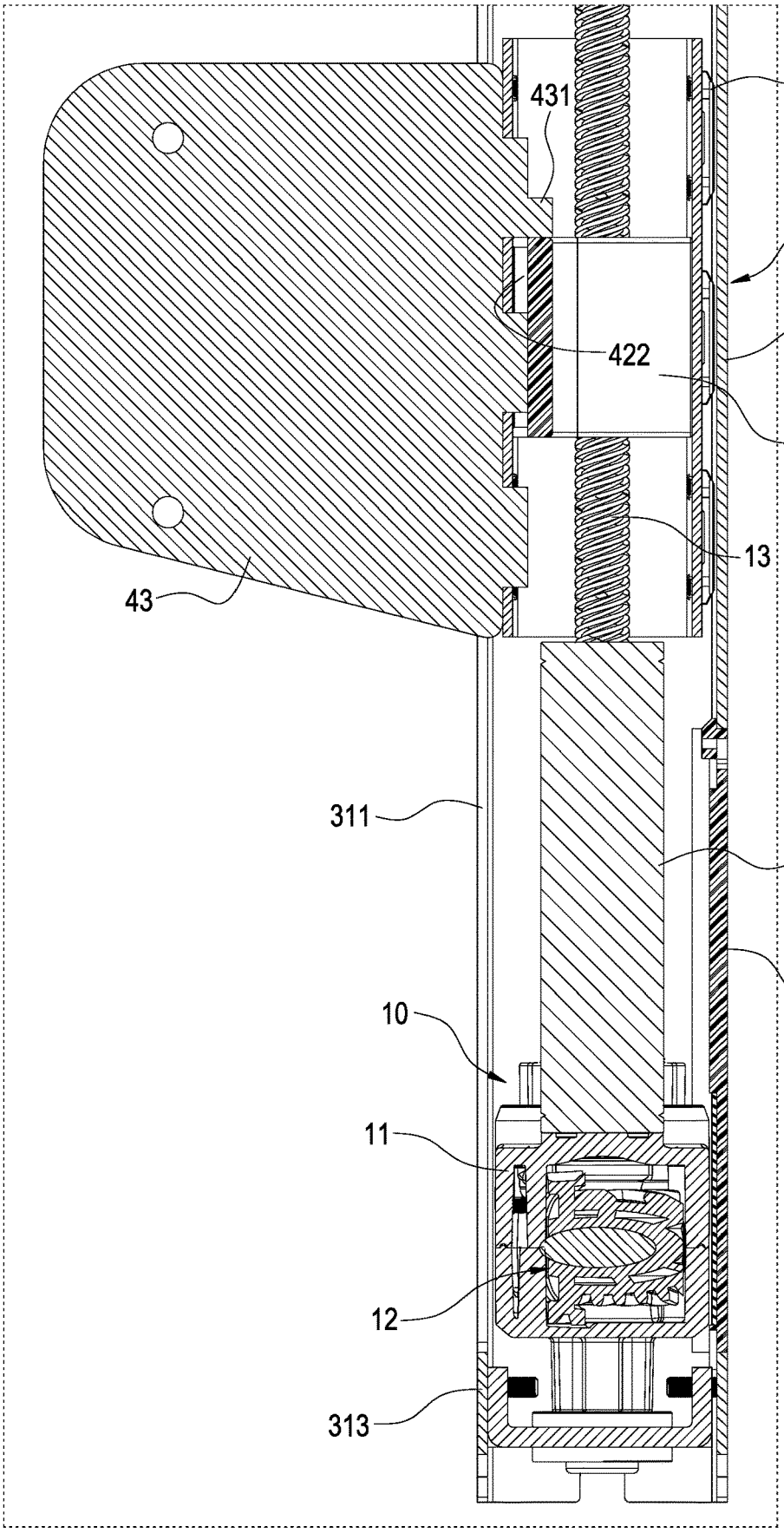
FIG. 4 is another cross-section view of the invention.
Figure 6:
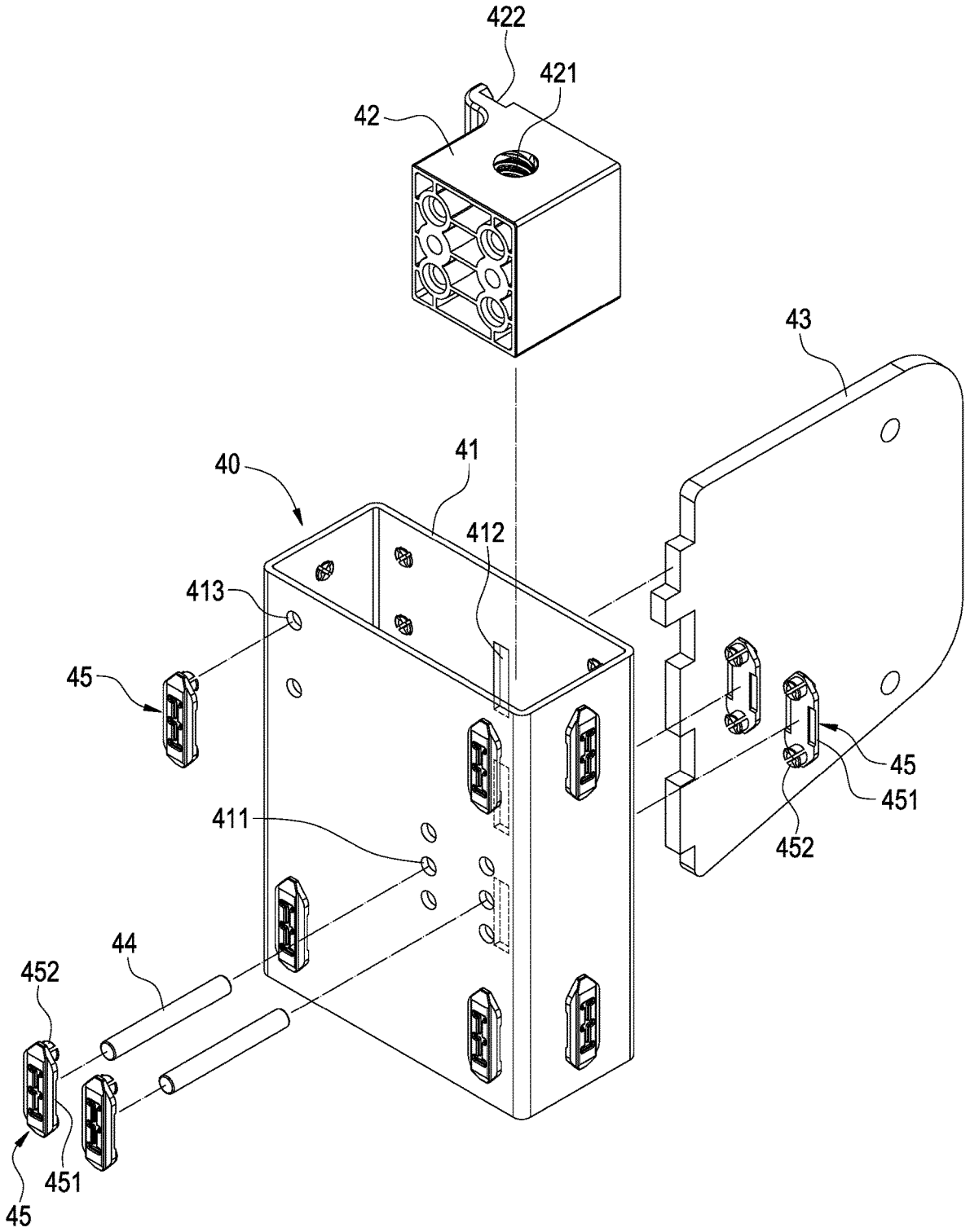
FIG. 6 is an exploded view of the moving assembly of the invention.
Figure 7:
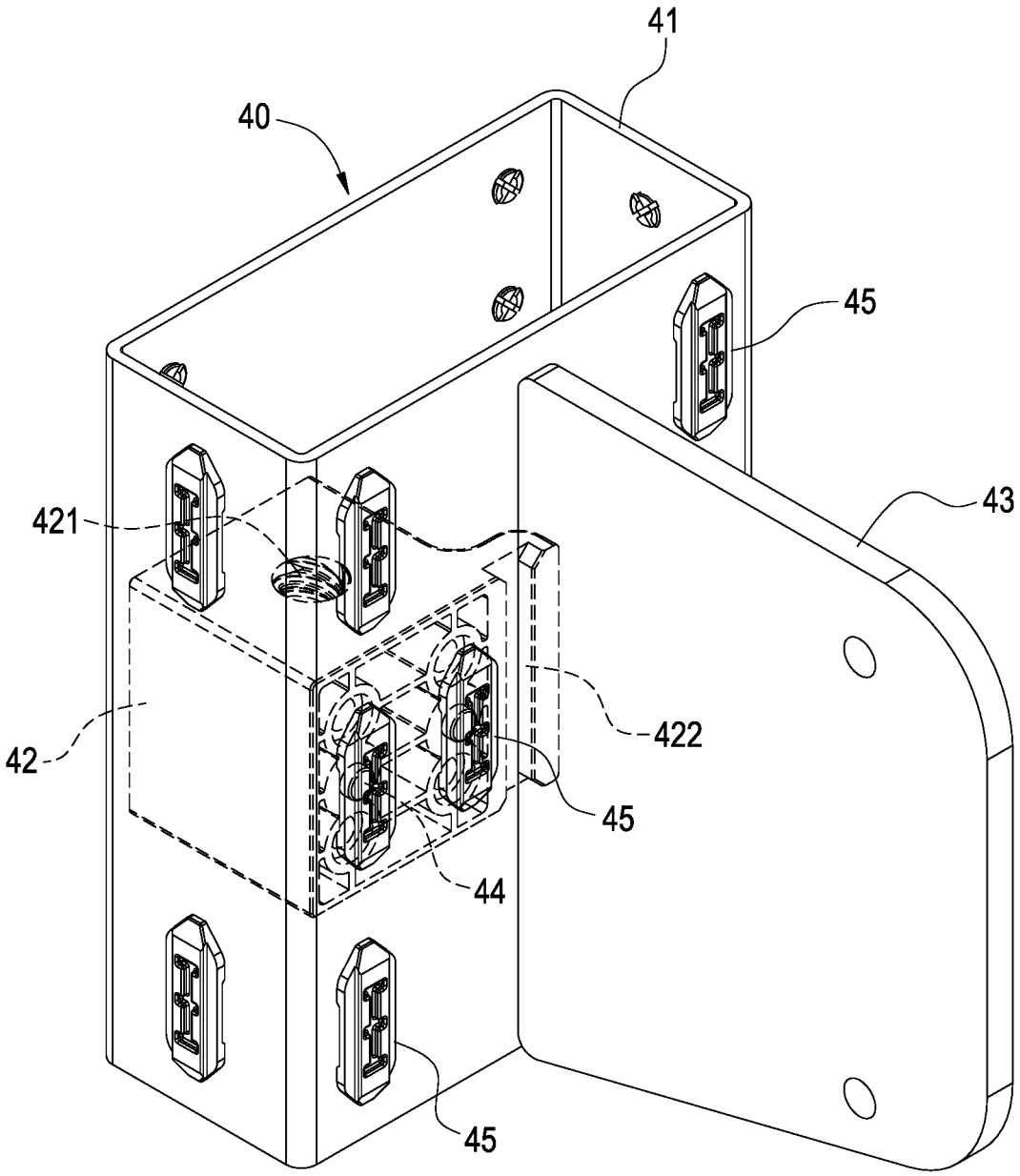
FIG. 7 is a schematic view of the moving assembly of the invention.

Please refer to FIGS. 4, 6 and 7. The moving assembly 40 is placed in the tube body 31 through the opening 314 to operatably connect to the transmission 10. The moving assembly 40 includes a frame 41, a nut 42 and a plate 43. A right half portion of the frame 41 is provided with fixing holes 411. The nut 42 is disposed in the frame 41 with corresponding to the fixing holes 41. The nut 42 is positioned in the frame 41 by inserting two pins 44 into the fixing holes 411. Each fixing hole 411 is provided with a fastener 45 to block two ends of each of the pins 44.

Further, the middle of the frame 41 is provided with trenches 412. The nut 42 is formed with a treaded hole 421 screwed with the lead screw 13. A side of the nut 42 is provided with a channel 422. The plate 43 passes through the trenches 412 and is embedded into the channel 422 to be fixed onto the nut 42 in a horizontal direction. The plate 43 further has a blocking portion 431. The blocking portion 431 is blocked by the top of the nut 42 to fix the plate 43 in a vertical direction. The plate protrudes from the tube body 31 by passing through the longitudinal trough 311 and is driven by the lead screw 13 to be vertically movable in the longitudinal trough 311.

Further, the fastener 45 includes a main board 451. A side of the main board 451 is provided with embedding hooks 452 which is fastened into the fixing hole 411.

Further, embedding holes 413 are formed at an upper portion, a lower portion and corners of the frame 41. The fasteners 45 are fixed at the embedding holes 413 by embedding the embedding hooks 452 into the embedding holes 413 and between the side panels of the frame 41 and the tube body 31. As a result, the fasteners 45 can keep the gap between the frame 41 and the tube body 31 to make the frame 41 capable of stably moving in the tube body 31 in a vertical direction.

Figure 8:
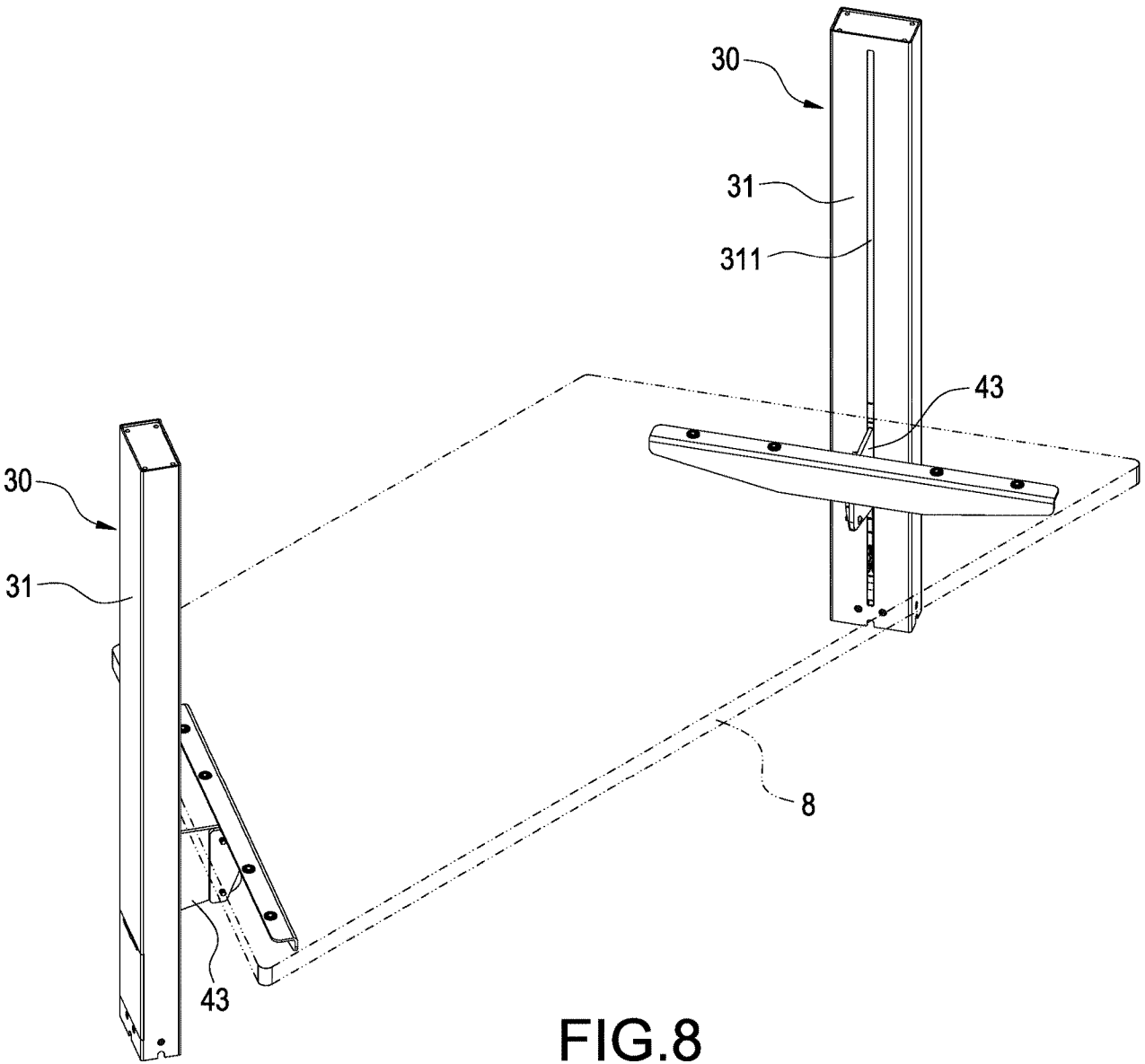
FIG. 8 is a schematic view of the invention used on a table.

Please refer to FIG. 8, which shows an embodiment of two slide type elevating posts installed on a tabletop 8. By the plates 43 driven by the transmission 10, the tabletop 8 can be adjusted to a proper height depending upon various requirements.

It will be appreciated by persons skilled in the art that the above embodiment has been described by way of example only and not in any limitative sense, and that various alterations and modifications are possible without departure from the scope of the invention as defined by the appended claims.

What is claimed is:

1. An elevating post comprising:

a transmission (10);

a driver (20) connected to the transmission (10);

an outer tube (30), receiving the transmission (10) and the driver (20), having a tube body (31) with a longitudinal trough (311), and two closed sections (312, 313) being separately disposed outside two ends of the longitudinal trough (311); and a moving assembly (40), operatably connected to the transmission (10), and having a plate (43) protruding from the tube body (31) by passing through the longitudinal trough (311) and being movable in the longitudinal trough (311), wherein a side panel of the tube body (31), which is opposite to the longitudinal trough (311), is formed with an opening (314), and the moving assembly (40) is placed in the tube body (31) through the opening (314).

2. The elevating post of claim 1, wherein the moving assembly (40) comprises a frame (41) and a nut (42), and the nut (42) is positioned in the frame (41) by inserting pins (44).

3. The elevating post of claim 2, wherein the moving assembly (40) comprises fasteners (45), each fastener (45) is provided with embedding hooks (452), the frame (41) is provided with embedding holes (413), the fasteners (45) are separately fixed at the embedding holes (413) by embedding the embedding hooks (452) into the embedding holes (413) and between side panels of the frame (41) and the tube body (31).

4. The elevating post of claim 1, wherein the moving assembly (40) further comprises a frame (41) and fasteners (45), each fastener (45) is fastened on the frame (41) and between the frame (41) and the tube body (31).

5. An elevating post comprising:

a transmission (10);

a driver (20) connected to the transmission (10);

an outer tube (30), receiving the transmission (10) and the driver (20), having a tube body (31) with a longitudinal trough (311), and two closed sections (312, 313) being separately disposed outside two ends of the longitudinal trough (311); and a moving assembly (40), operatably connected to the transmission (10), and having a plate (43) protruding from the tube body (31) by passing through the longitudinal trough (311) and being movable in the longitudinal trough (311), wherein the moving assembly (40) comprises a frame (41) and a nut (42), and the nut (42) is positioned in the frame (41) by inserting pins (44), wherein the frame (41) is provided with fixing holes (411), each fixing hole of said fixing holes (411) is provided with a fastener (45) to block two ends of each of the pins (44).

6. The elevating post of claim 5, wherein the fastener (45) comprises a main board (451), a side of the main board (451) is provided with embedding hooks (452) which is fastened into the fixing hole (411).

7. The elevating post of claim 5, wherein the frame (41) is provided with trenches (412), the transmission (10) comprises a lead screw (13), the nut (42) is screwed to the lead screw (13), a side of the nut (42) is provided with a channel (422), and the plate (43) passes through the trenches (412) and is embedded into the channel (422) to be fixed onto the nut (42) in a horizontal direction.

8. The elevating post of claim 7, wherein the plate (43) further has a blocking portion (431), the blocking portion (431) is blocked by a top of the nut (42) to fix the plate (43) in a vertical direction.

9. An elevating post comprising:

a transmission (10);

a driver (20) connected to the transmission (10);

an outer tube (30), receiving the transmission (10) and the driver (20), having a tube body (31) with a longitudinal trough (311), and two closed sections (312, 313) being separately disposed outside two ends of the longitudinal trough (311); and a moving assembly (40), operatably connected to the transmission (10), and having a plate (43) protruding from the tube body (31) by passing through the longitudinal trough (311) and being movable in the longitudinal trough (311), wherein the outer tube (30) further comprises a cover (32), a side panel of the tube body (31), which is opposite to the longitudinal trough (311), is formed with an opening (314), and the cover (32) cloaks the opening (314).

* * * * *